US007185948B2

(12) United States Patent
Liu

(10) Patent No.: US 7,185,948 B2
(45) Date of Patent: Mar. 6, 2007

(54) COLLAPSIBLE RECLINING CHAIR

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 66 days.

(21) Appl. No.: 11/166,149

(22) Filed: Jun. 27, 2005

(65) Prior Publication Data

US 2006/0038431 A1 Feb. 23, 2006

(30) Foreign Application Priority Data

Aug. 18, 2004 (CN) ..... 2004 2 00819467

(51) Int. Cl.
*A47C 4/00* (2006.01)

(52) U.S. Cl. ..... 297/30; 297/39; 297/16.1

(58) Field of Classification Search ..... 297/16.1, 297/19, 21, 27, 28, 29, 30, 31, 39
See application file for complete search history.

(56) References Cited

U.S. PATENT DOCUMENTS 5,464,270 A * 11/1995 Chang ..... 297/81
5,570,926 A * 11/1996 Papiernik et al. ..... 297/39
6,517,151 B2 * 2/2003 Liu ..... 297/16.1
6,536,839 B2 * 3/2003 Liu ..... 297/39
6,595,582 B1 * 7/2003 Liu ..... 297/35
6,692,068 B1 * 2/2004 Tang ..... 297/16.2
6,755,463 B2 * 6/2004 Lardieri et al. ..... 297/35
6,902,231 B1 * 6/2005 Tseng ..... 297/27
7,063,380 B1 * 6/2006 Cui ..... 297/30
2002/0125745 A1 * 9/2002 Lee ..... 297/30

FOREIGN PATENT DOCUMENTS

CN 2346300 Y 11/1998

* cited by examiner

*Primary Examiner*—Peter M. Cuomo
*Assistant Examiner*—Sarah B. McPartlin
(74) *Attorney, Agent, or Firm*—Birch, Stewart, Kolasch & Birch, LLP

(57) ABSTRACT

A collapsible reclining chair allowing users to adjust the recline angle according to their desire, and allowing users to use it safely. It comprises a supporting frame consisting of a front and a rear leg frame, a seat tubes, arm tubes a back frame, a feet frame, an armrest pad and a lying pad. The front leg frame and the arm tubes have a fastening device, which is for users to adjust and fix the position of the chair according their desires. A safety device is mounted on the linkage between the rear leg frame and the seat tubes. The safety device is used to fasten and fix the supporting frame, so that the supporting frame will not shift easily due to external force, thus allowing user to use the reclining chair more safely and comfortably.

5 Claims, 11 Drawing Sheets

COLLAPSIBLE RECLINING CHAIR

FIELD OF THE INVENTION

The present invention relates to a collapsible reclining chair and, more particularly, a collapsible reclining chair allowing users to adjust the recline angle according to their desire and allowing users to use it safely.

BACKGROUND OF THE INVENTION

The main demand for a general collapsible reclining chair is nothing more than just being convenient and comfortable, and it should contain the merit of being relatively easily for preservation and portability. Collapsible reclining chair is used to facilitate utilization and allows users to adjust the back portion to be inclined at a variety of angles according to the desire of user to satisfy the most comfort. If the design of a collapsible reclining chair is not satisfactory, it will inevitably lose its main objective, the description below illustrates a conventional collapsible reclining chair:

Please refer to FIG. 1 Prior Art, which illustrates a general structure of a conventional collapsible reclining chair. Such structure comprises a seat frame 10, a supporting leg frame 11 pivotally attached to the seat frame 10, a back frame 13 which is pivotally connected to the supporting leg frame 11 by a lever 12, two armrests 14 which are pivotally attached to the back frame 13, two locking tubes 15 are located at the top ends of the supporting leg frame 11, and two restricting plates 16 connecting to the bottom edges of the front ends of the armrests 14 respectively. Such restricting plates 16 having a plurality of receiving slots 160 relative to the locking tubes 15. During utilization, user can adjust the inclining angle of the chair, simply by allowing the stated locking tubes 15 to be fastened and positioned within different receiving slots 160. However, such structure still contains quite a number of defects, the following descriptions will explain those problems:

Although the conventional structure includes the design of a plurality of receiving slots 160, for adjusting the reclining chair to be inclined at a variety of angles, so as to satisfy the desire of user. However, due to the quantity constraint of the receiving slots 160, the chair cannot be inclined at more angles. And the inclined angle according to the location of the receiving slots 160 is actually fixed. Thus, such design is not flexible enough to satisfy the desire of a user. Furthermore, user has to leave the chair before he or she can make any adjustment.

Therefore, the conventional collapsible reclining chair is not desirable in the current market demand owing to the above all sorts of inconveniencies. In respect to those defects, some inventors redesign the collapsible reclining chair so as to improve the above problems. Such as People's Republic of China Patent Number CN2346300Y, disclosed an adjusting device installed on a guiding lever, such adjusting device can allow users to adjust the inclining angle of the collapsible reclining chair according to their desire. Such adjusting device does not have the limitation of the inclined angle being adjusted, which means the range for adjustment is wider and thus solve the defect of the conventional collapsible reclining chair that cannot be adjusted very flexibly.

However, the conventional collapsible reclining chair still consists of another defect, that is, the design of the supporting frame is lacked of a fixed device. Thus, it is common for the supporting frame to slide freely due to the imbalance weight and unsteady center of gravity, when user is adjusting the inclined angle of the chair or just lying down on the chair. The supporting frame might slide further and collapse to perform a close state, causing the user to fall from the chair and injured, the reclining chair will eventually damage too. To conclude, another problem owing to the safety of the reclining chair is now becoming the prior topic for those innovators.

SUMMARY OF THE INVENTION

It is a primary object of the present invention is to provide a collapsible reclining chair for adjusting it to be inclined at a variety of angles, so as to allow user to lie on the chair safely.

In order to achieve the foregoing objects, the present invention includes a supporting frame which is consisted of a front and a rear leg frame, two seat tubes which are linked to the above rear leg frame, two arm tubes which are linked to the above front leg frame, a back frame which is pivotally attached to one end of the arm tubes and one end of the seat tubes, a feet frame which is pivotally attached to the other end of the arm tubes and one end of the seat tubes, two armrest pads which are pivotally connected to the two ends of the arm tubes, and a lying pad which is mounted between the above back frame, the seat tubes and the feet frame. The present invention also includes a fastening device installed on the linkage of the front leg frame and the arm tubes, and a safety device that is mounted on the linkage between the rear leg frame and the seat tubes.

The fastening device allows users to adjust and fix the position of the chair according their desires, and the safety device is used to fasten and fix the supporting frame, so that the supporting frame will not shift easily due to external force, thus allowing user to use the reclining chair more safely and comfortably.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
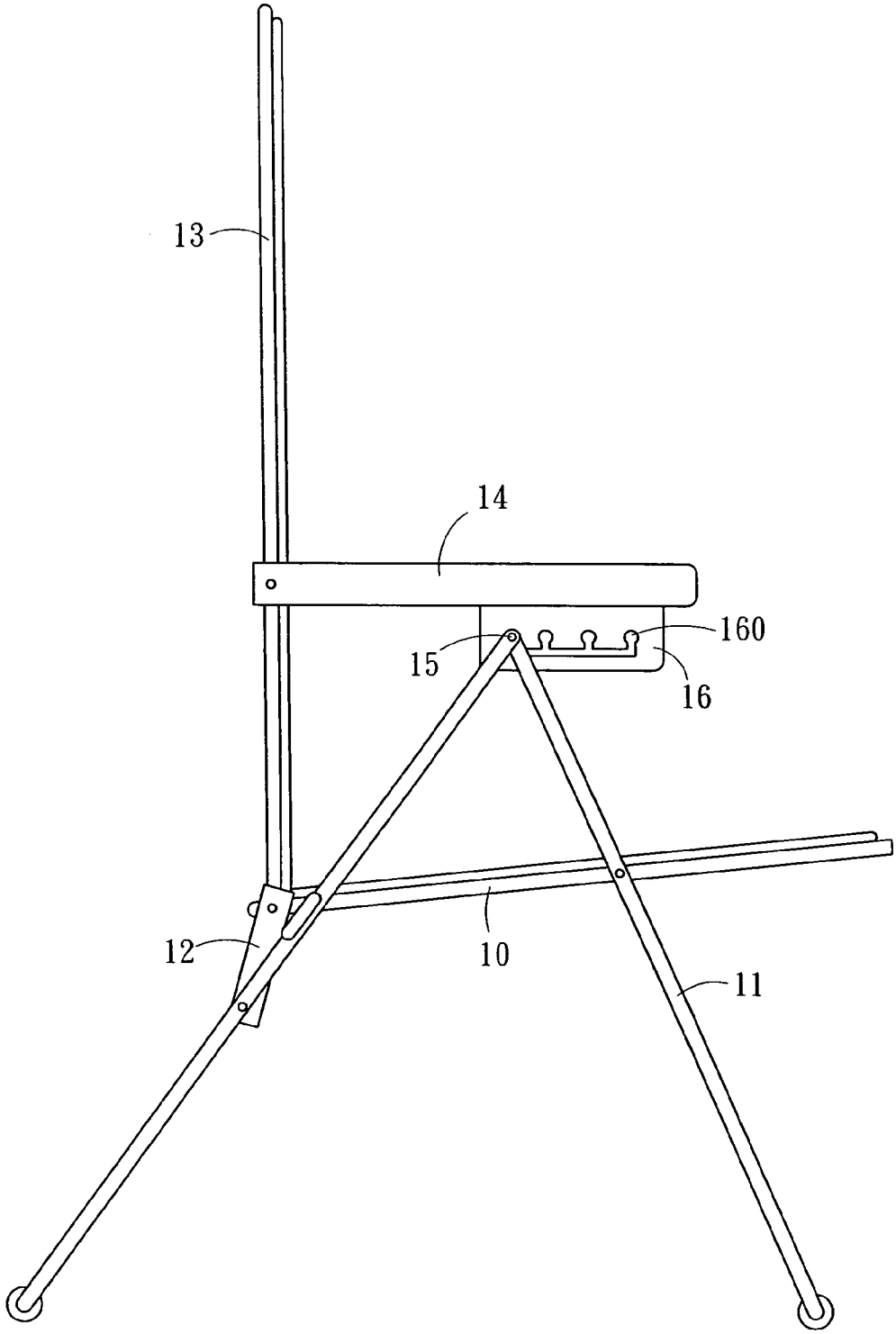
Fig. 1 Prior Art
FIG. 1 Prior Art illustrates the structure of a conventional collapsible reclining chair.
Figure 2:
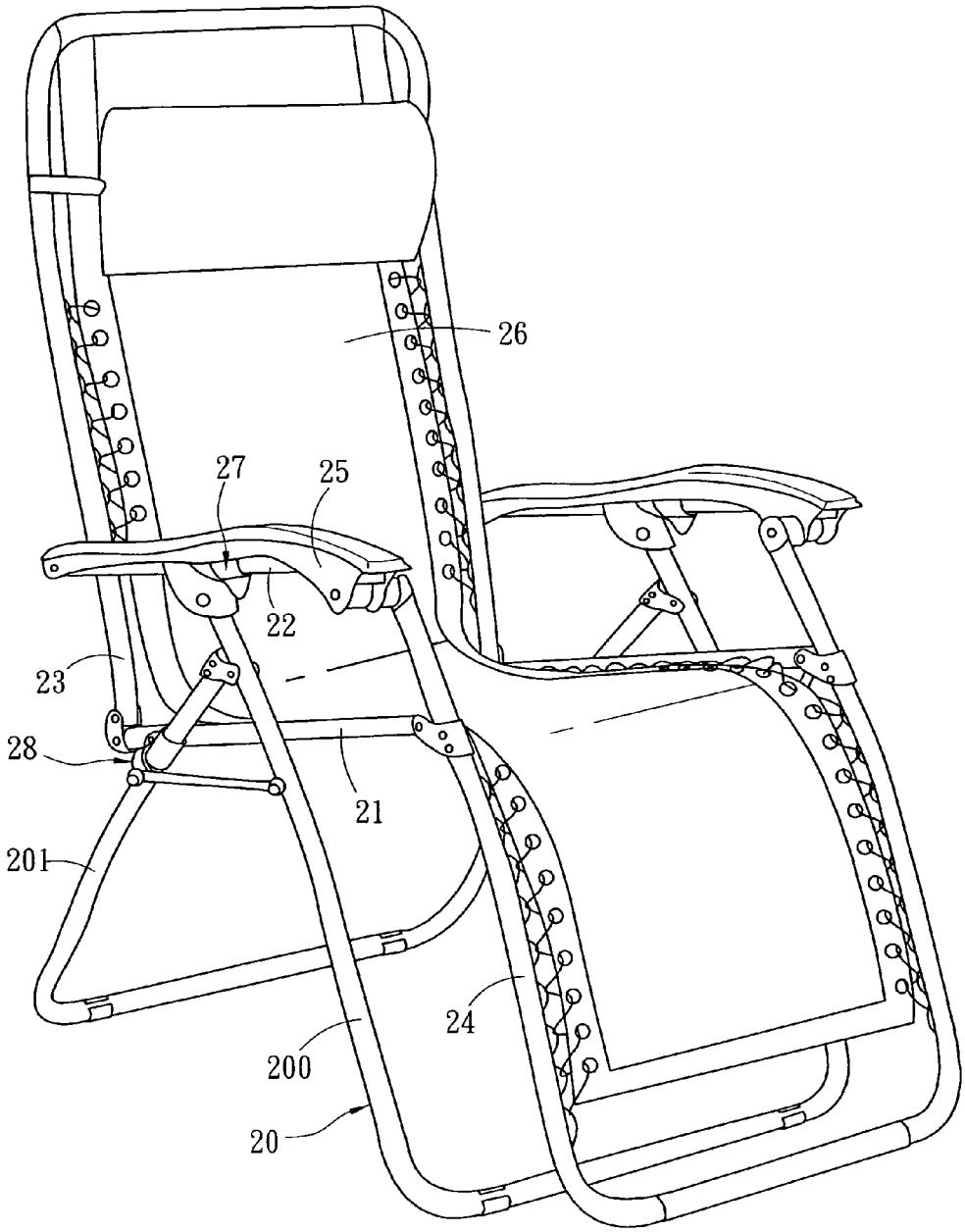
FIG. 2 illustrates the preferred embodiment of the present invention.

The present invention includes a simple structural design, so as to allow user to adjust the reclining chair to be inclined at a variety of angles according to their desire for satisfying the most comfort, and it is relatively safe to lie on such reclining chair. Please refer to FIG. 2, which illustrates the preferred embodiment of the present invention. As illustrated, the present invention includes a supporting frame 20 which is consisted of a front and a rear leg frame 200, 201, two seat tubes 21 which are linked to the above rear leg frame 201, two arm tubes 22 which are linked to the above front leg frame 200, a back frame 23 which is pivotally attached to one end of the arm tubes 22 and one end of the seat tubes 21, a feet frame 24 which is pivotally attached to the other end of the arm tubes 22 and one end of the seat tubes 21, two armrest pads 25 which are pivotally connected to the two ends of the arm tubes 22, and a lying pad 26 which is mounted between the above back frame 23, the seat tubes 21 and the feet frame 24.

Figure 3:
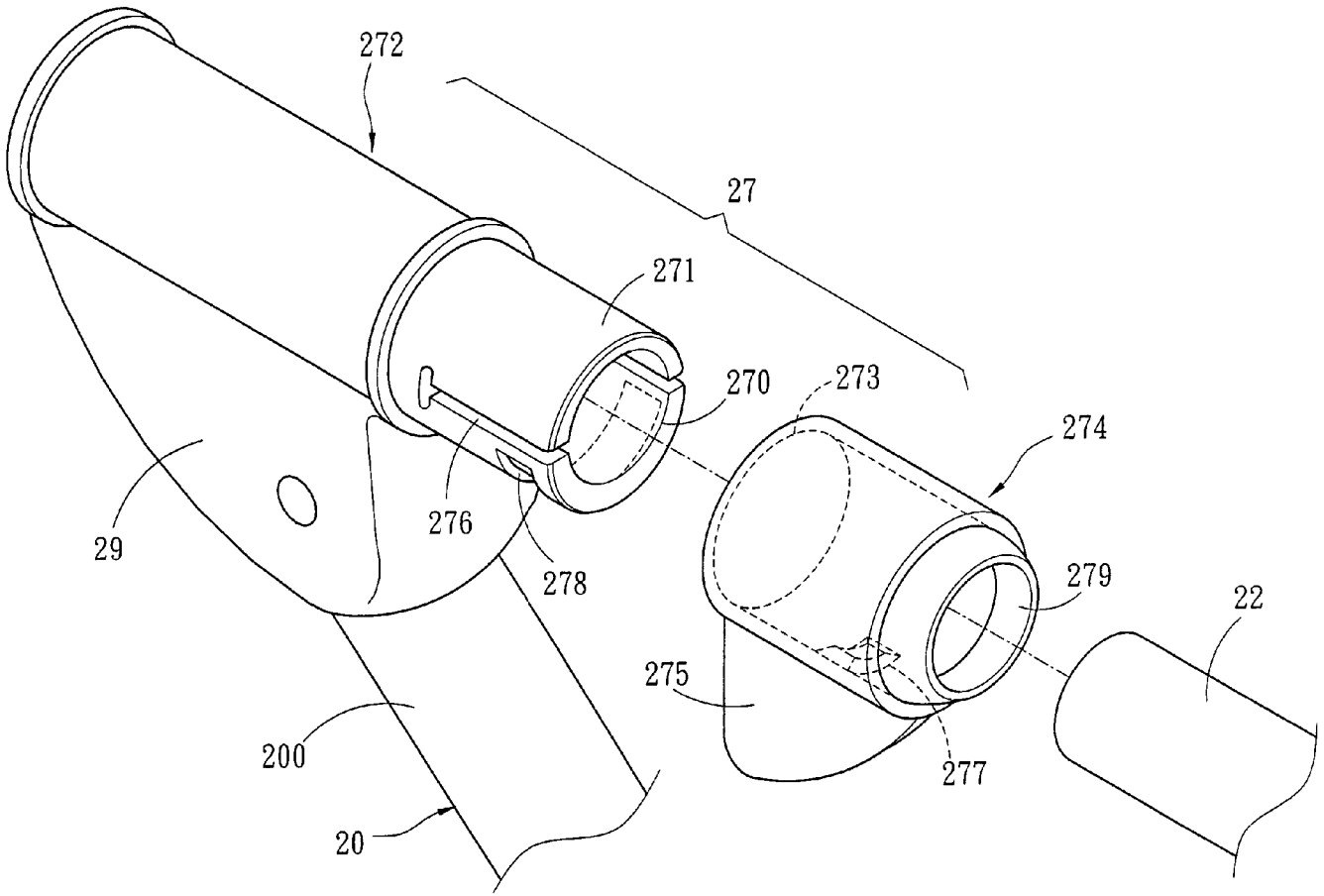
FIG. 3 illustrates an exploded view of a fastening device of the present invention.
Figure 4:
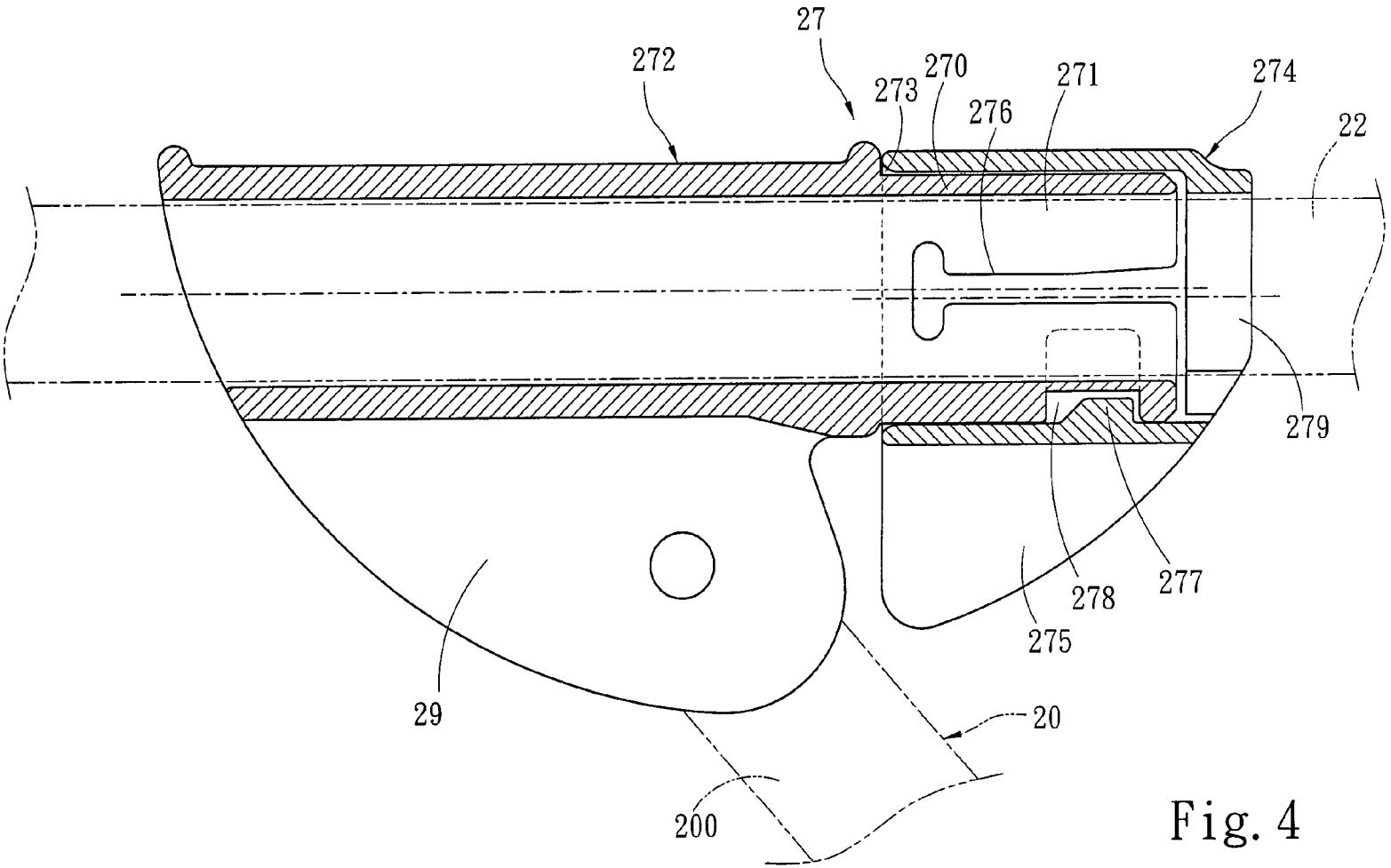
FIG. 4 illustrates a sliced view of a fastening device of the present invention.

The connection between the above front leg frame 200 and the arm tubes 22 has a fastening device 27 (please refer to FIGS. 3 and 4, which illustrate an explored view and a sliced view of a fastening device 27 of the present invention). The fastening device 27 comprises a housing body 272 (such housing body 272 includes a connecting portion 29 used to connect the front leg frame 200) which consists of a penetrated hole 270 and a receiving portion 271, a guiding hole 273 and a housing hole 279 which is eccentric to (having different center of circles) the guiding hole 273, such housing hole 279 is inserted into a positioning cover 274 of the receiving portion 271 of the housing body 272 (the positioning cover 274 further consists of a controlling portion 275 for user to operate, which means that user can adjust and fix the position of the chair that he or she desires for lying down or sitting down in order to satisfy most comfort). And, the penetrated hole 270 of the housing body 272 is concentric to (having same center of circles) the housing hole 279 of the positioning cover 274. Wherein, a cut slot 276 is formed axially on the above receiving portion 271.

The arm tube 22 passes through the penetrated hole 270, the guiding hole 273 and the housing hole 279. The positioning cover 274 will slide on the circumference of the receiving portion 271. Since the penetrated hole 270 is eccentric to the guiding hole 273, a locking member 277 of the positioning cover 274 will press against the receiving portion 271 of the housing body 272 (A locking member 277 is formed within the positioning cover 274. A slot 278 is formed on the receiving portion 271 of the housing body 272 located relatively to the position of the locking member 277. The locking member 277 can slide within the limited space of the slot 278, and they form a tight state when reaching the end of the sliding space).

Figure 5B:
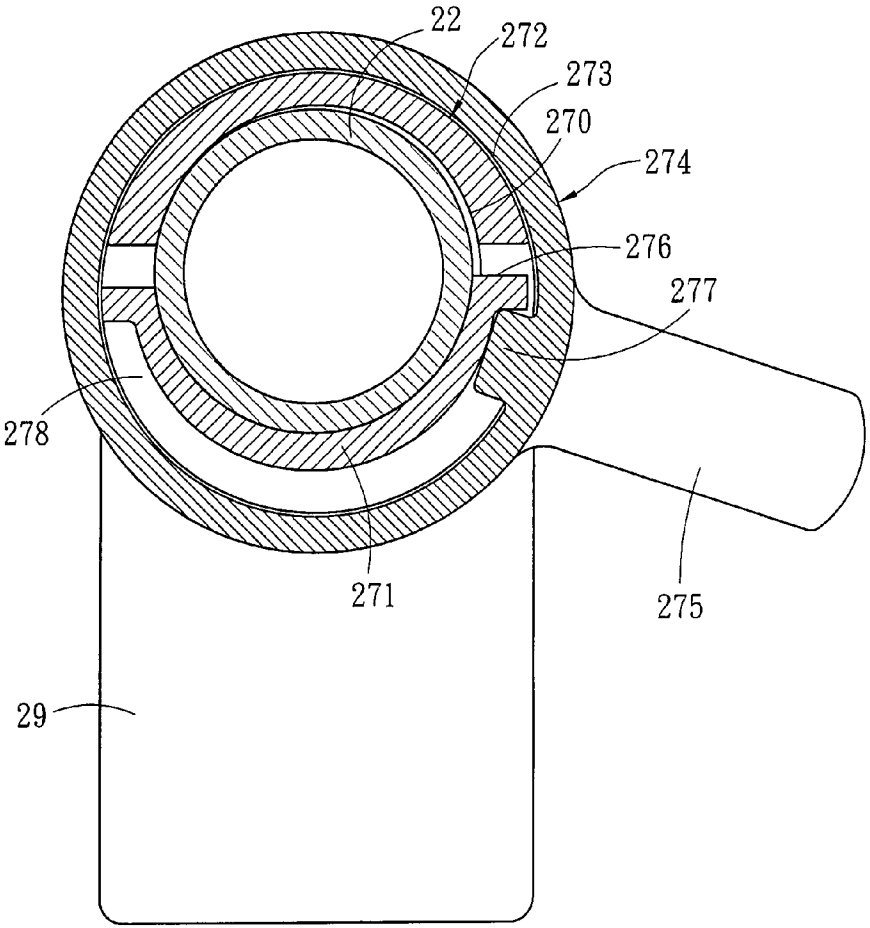
FIGS. 5A and 5B illustrate the motion of the fastening device of the present invention.
Figure 5A:
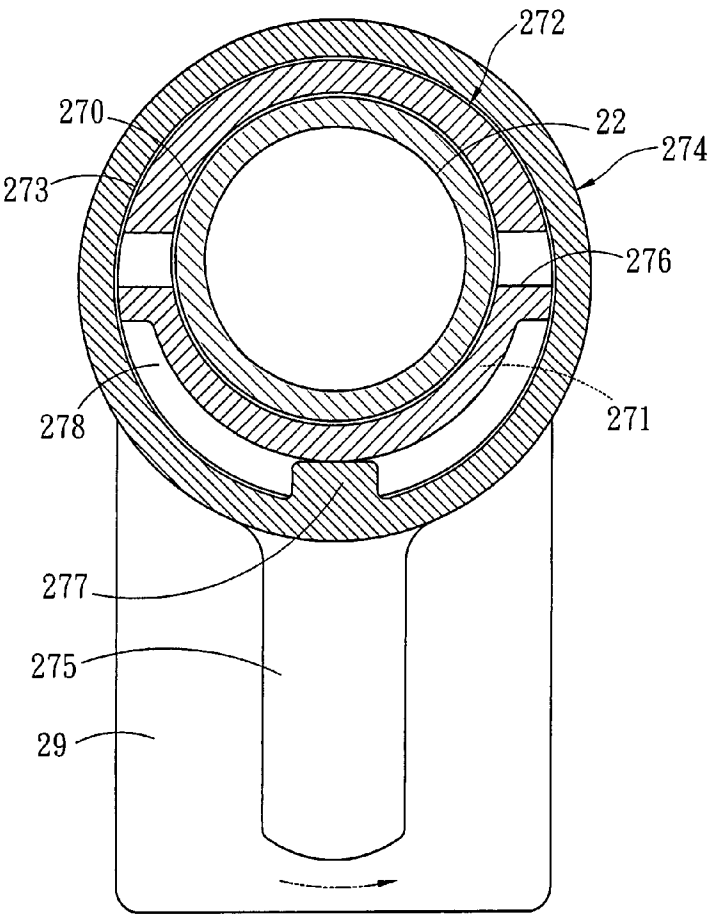

Owing to the formation of the cut slot 276, the cut slot 276 of the receiving portion 271 will be under a pressing force, and the receiving portion 271 will indirectly press on the arm tube 22 which is inserted into the housing body 272, forming a tight state in the end (The inclined angle of the reclining chair can be fixed by simply rotating the controlling portion 275 of the positioning cover 274 to the right and then to the left, as shown in FIGS. 5A and 5B, which illustrate the motion of the fastening device 27 of the present invention);

In addition, a safety device 28 is mounted on the linkage between the rear leg frame 201 and the seat tubes 21. Such safety device 28 comprises a coupling member 281 that consists of a dwelling portion 280, and a fixed member 282 that is equipped on the dwelling portion 280 of the coupling member 281. Wherein, the two ends of the coupling member 281 are pivotally connected to a lever 283 and a linking member 284. The other end of the lever 283 is pivotally linked to the front leg frame 200. The linking member 284 is pivotally attached to the seat tubes 21 at the pivotal end of the coupling member 281, the other end of the linking member 284 is pivotally attached to the rear leg frame 201. The above fixed member 282 is mounted on the rear leg frame 201.

Figure 6A:
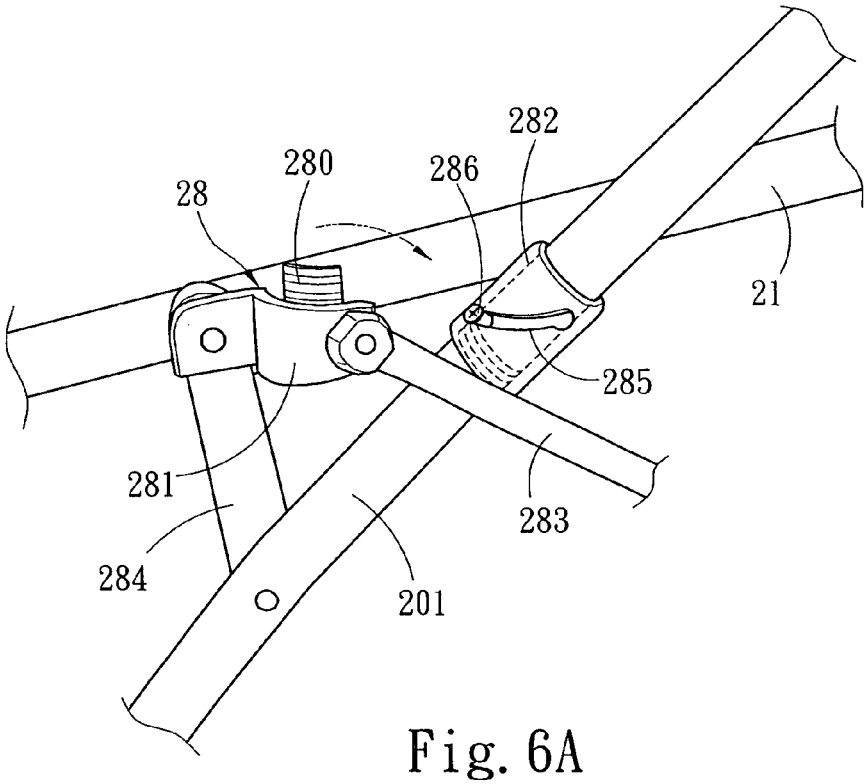
FIGS. 6A, 6B and 6C illustrate the motion of the safety device of the present invention.
Figure 6B:
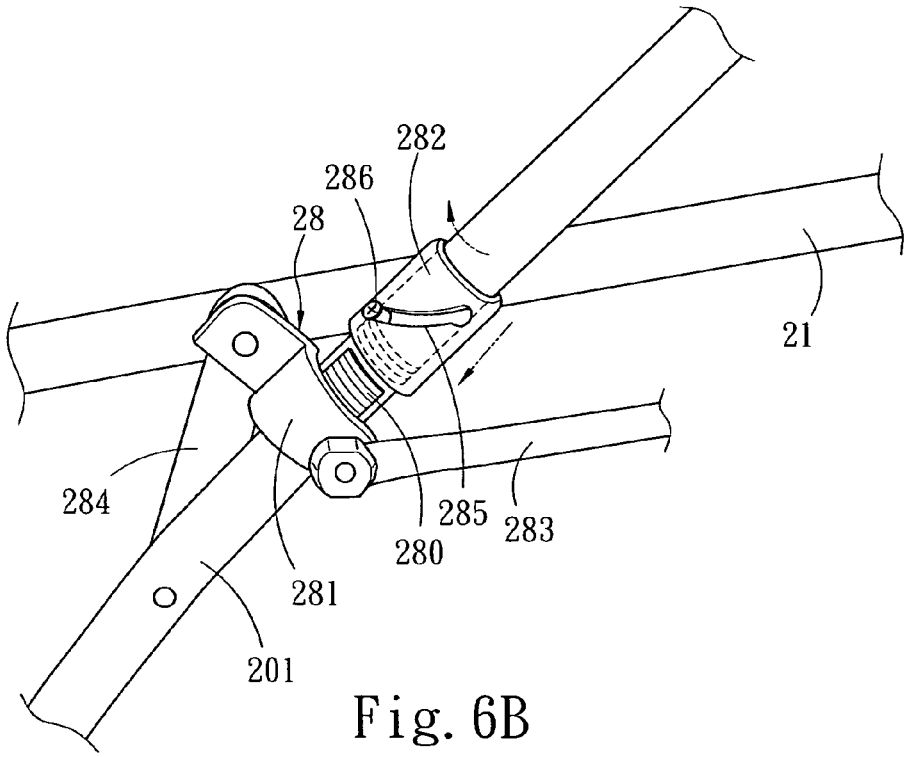
Figure 6C:
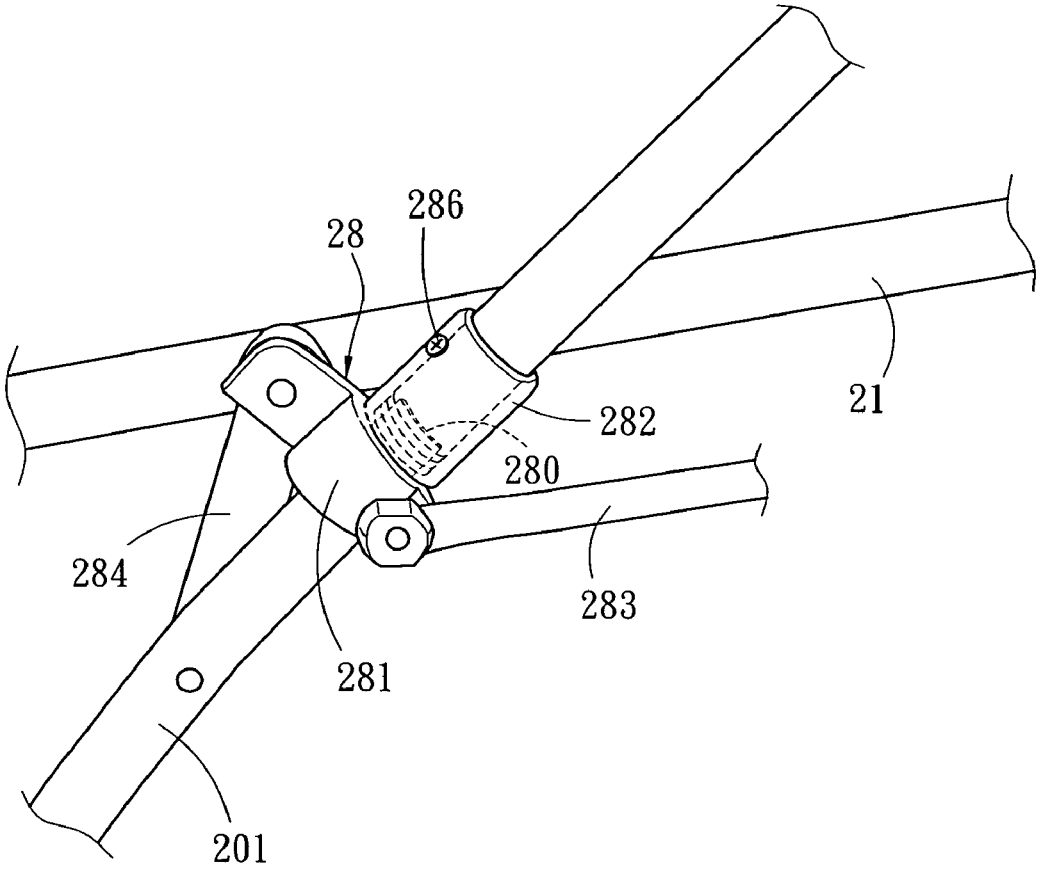

During utilization, allowing the coupling member 281 to lean against the rear leg frame 201, and use the fixed member 282 to cover the dwelling portion 280 of the coupling member 281 to form a fastened state. (The method of sliding, the fixed member 282 further includes a sliding slot 285. A fixed plate 286 is formed on the rear leg frame 201 at a relative position to the sliding slot 285. Such fixed plate 286 and the sliding slot 285 can perform a sliding and a fixed position relationship). (The dwelling portion 280 of the coupling member 281 having male thread, and the interior of the fixed member 282 further having female thread in accordance to the male thread of the dwelling portion 280. According to the fixed plate 286 slides relatively on the sliding slot 285, allowing the male thread to fasten with the female thread). FIGS. 6A, 6B and 6C illustrate the motion of the safety device 28 of the present invention. As a result of the fastened state, the supporting frame 20 which is mainly used for supporting weight of the reclining chair can be fixed with no motion, so as to form a safe reclining chair and also allows users to adjust the chair to be inclined at a variety of angles according to his or her desire.

It is obvious from the above structural design that, the present invention takes the advantage of having the controlling portion 275 mounted on the fastening device 27 which is located at the connection of the front leg frame 200 and the arm tube 22. Through the eccentricity design concept, allowing user to just rotate the controlling portion 275 to its right and left so as to adjust the reclining angle of that chair. During adjustment, user only needs to press down the controlling portion 275 and adjust according ones desire, and then rotate the controlling portion 275 to its left or right in order to fasten it after adjustment. The present invention further includes a safety device 28 equipped at the connection between the rear leg frame 201 and the seat tubes 21. The chair can be fixed and more stable after the fixed member 282 of the safety device 28 is coupled to the dwelling portion 280 of the coupling member 281. Thus, the supporting frame 20 that is used for supporting different weights can be steadier, and preventing user from injured or falling down from the chair due to the imbalance weight and unsteady center of gravity, thus satisfies the safety objective.

Figure 7:
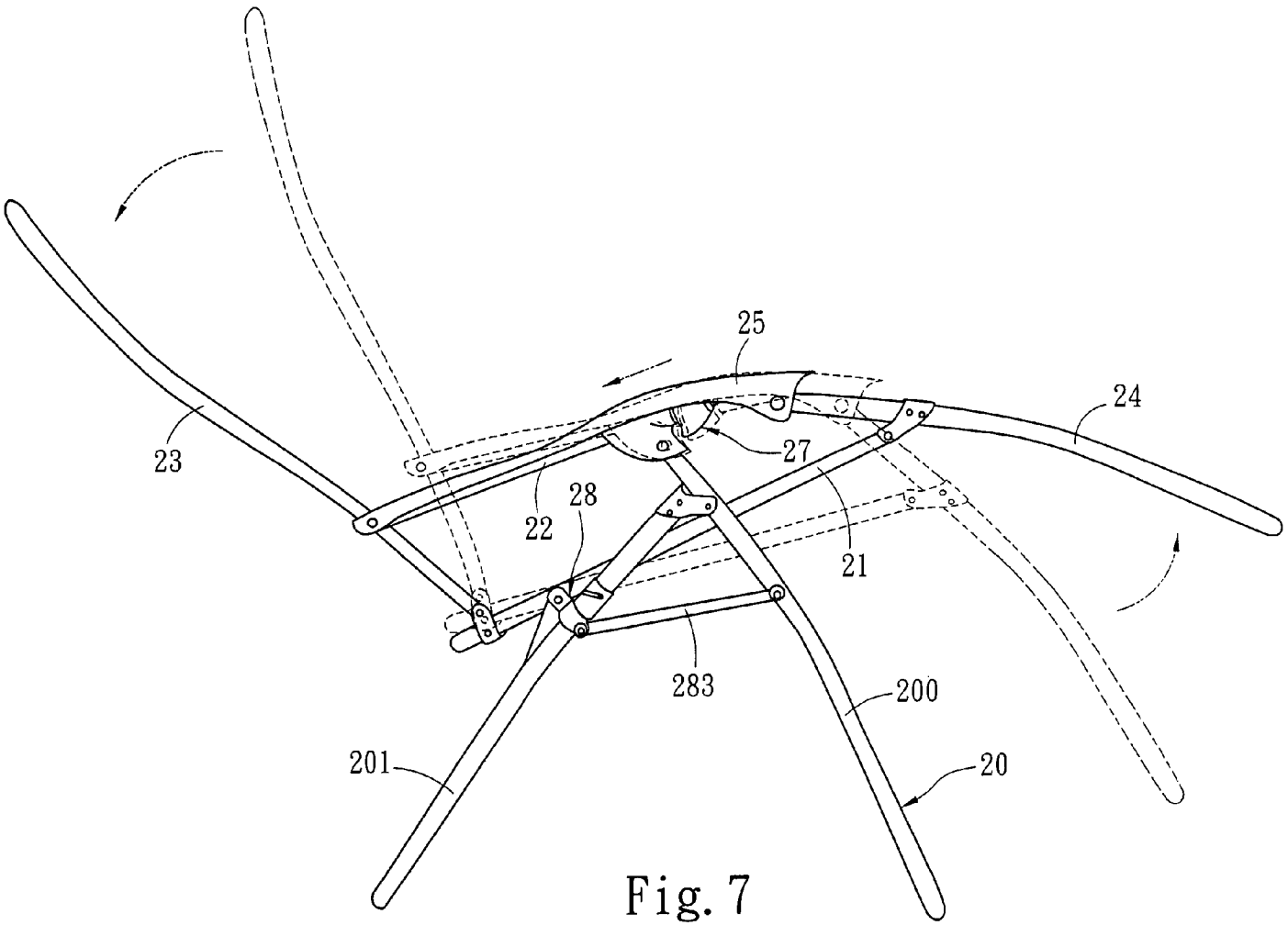
FIG. 7 illustrates a utilized state of the present invention.
Figure 8A:
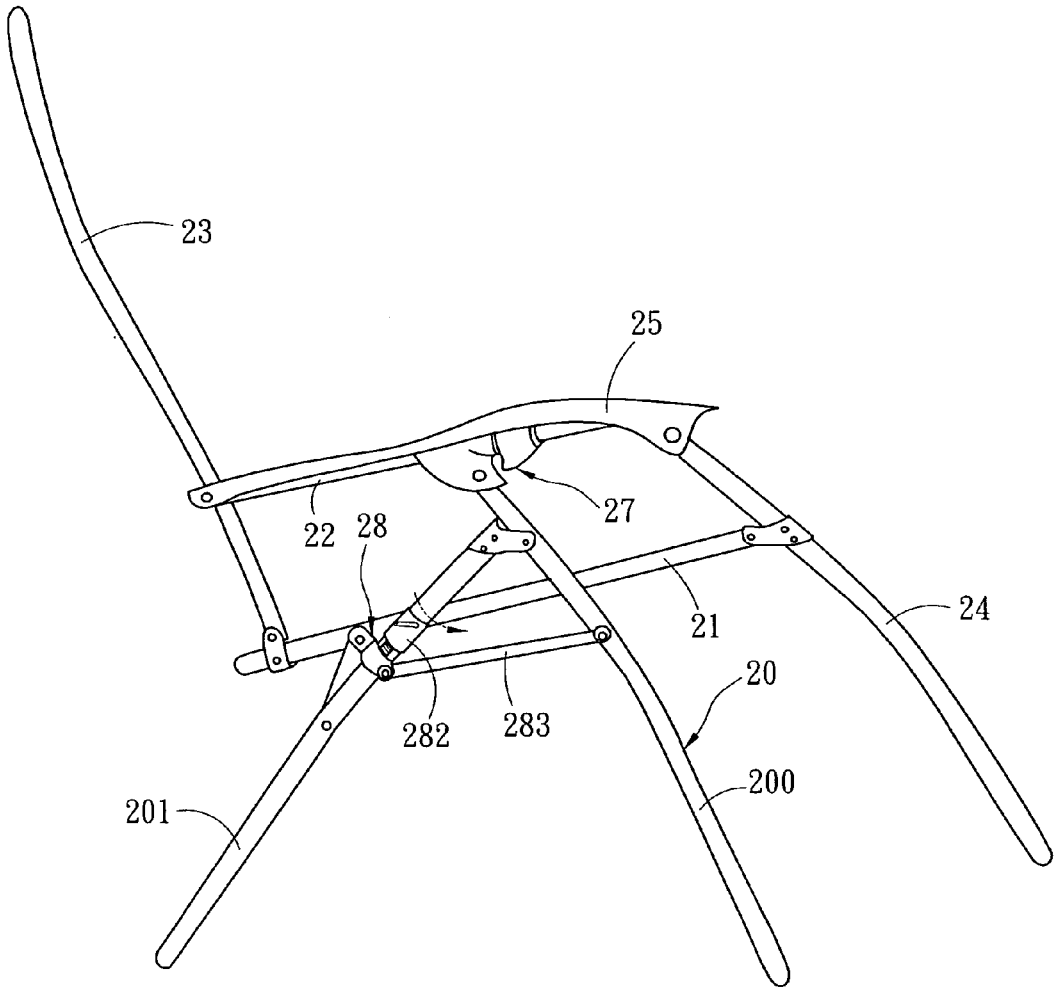
FIGS. 8A, 8B and 8C illustrate the stackable states of the present invention.
Figure 8B:
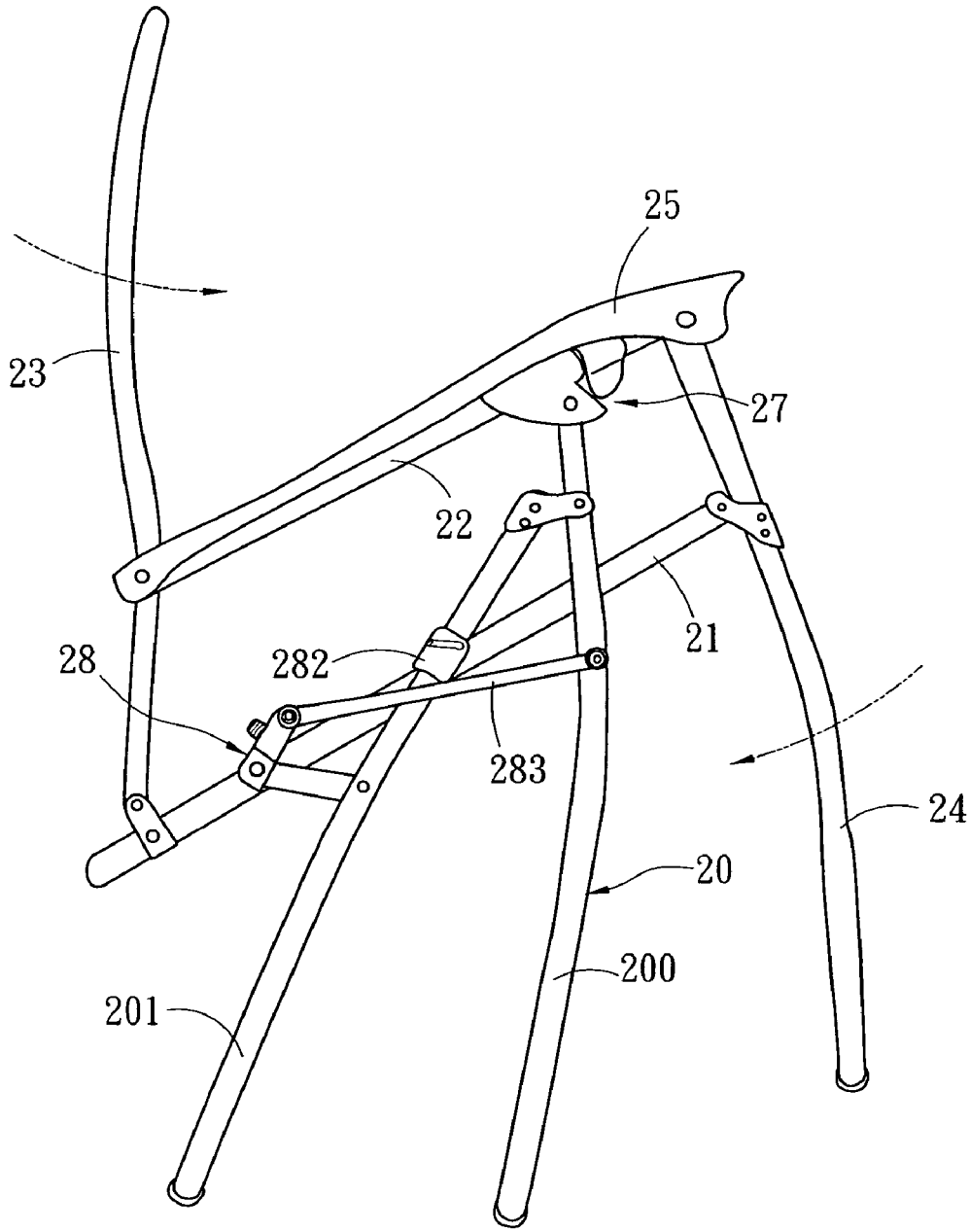
Figure 8C:
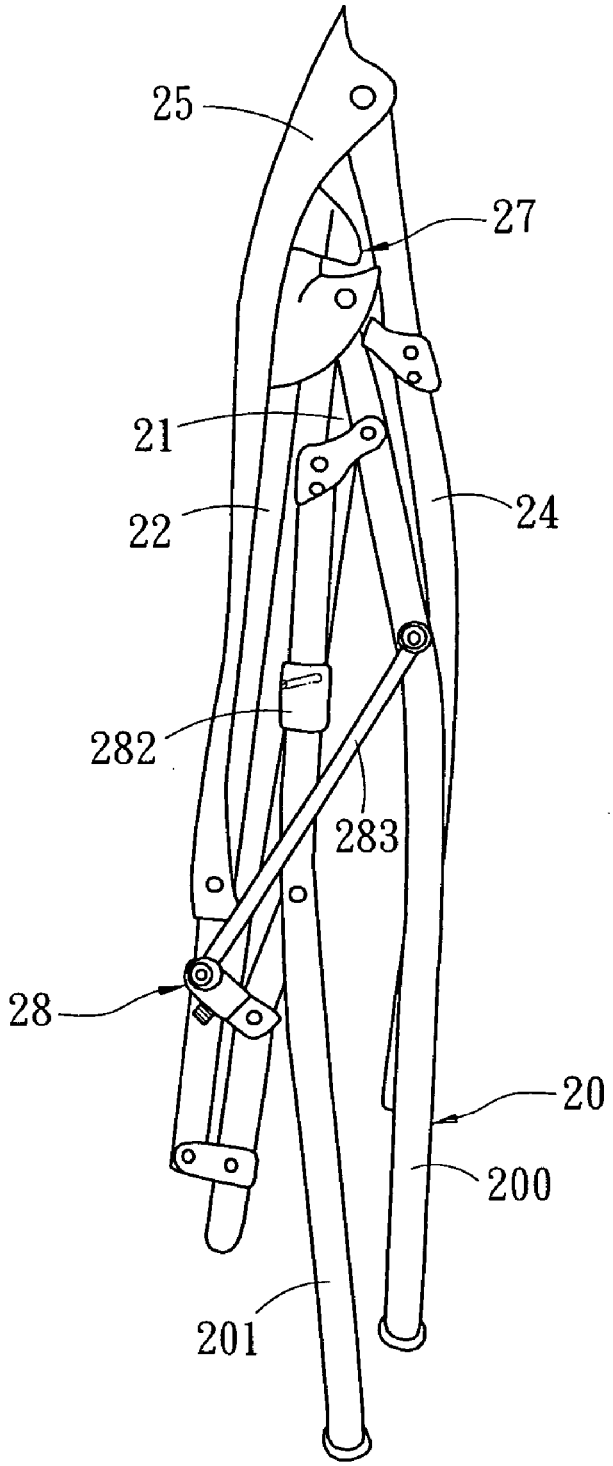

The inclining angle of the present invention can be adjusted according to the user's desire. Please refer to FIG. 7, which illustrates a utilized state of the present invention. The inclining angles are changing according to adjusting the fastening device 27. Furthermore, the present invention is easy to fold and stack for storage and transportation owing to its structural design (please refer to FIGS. 8A, 8B and 8C, which illustrate the stackable states of the present invention). As shown in the figures, user only needs to release the fixed member 282 of the safety device 28, and presses the back frame 23 and the feet frame 24 inwardly, the chair is collapsed as shown in FIG. 8C, thus enhancing convenient storage and transportation.

Although the invention has been explained in relation to its preferred embodiment, it is not used to limit the invention. It is to be understood that many other possible modifications and variations can be made by those skilled in the art without departing from the spirit and scope of the invention as hereinafter claimed.

What is claimed is:

1. A collapsible reclining chair allowing users to adjust a recline angle according to their desire, and allowing users to use the chair safely, said collapsible reclining chair comprises;

a supporting frame having of a front and a rear leg frame;

two seat tubes linked to the rear leg frame;

two arm tubes linked to the front leg frame;

a back frame pivotally attached to one end of the arm tubes and one end of the seat tubes;

a feet frame pivotally attached to the other end of the arm tubes and the other end of the seat tubes;

two armrest pads which are pivotally connected to the two ends of the arm tubes, and a lying pad which is mounted between the above back frame, the seat tubes and the feet frame, wherein:

said front leg frame and the arm tubes having a fastening device, the fastening device comprises a housing body used to insert into a positioning cover, the housing body having a penetrated hole which is concentric to the arm tube, a receiving portion is mounted on the circumference of the penetrated hole, a slot is formed on the receiving portion and a cut slot is formed on the receiving portion, the positioning cover having a guiding hole which is eccentric to the arm tube, a housing hole which is eccentric to the guiding hole and concentric to the arm tube, and a locking member corresponding to the slot, a safety device is mounted on the linkage between the rear leg frame and the seat tubes, such safety device comprises a coupling member that consists of a dwelling portion, and a fixed member that is mounted on the dwelling portion of the coupling member, wherein, two ends of the coupling member are pivotally connected to a lever and a linking member, the lever is pivotally linked to the front leg frame, the linking member is pivotally attached to the seat tubes at a pivotal end of the coupling member, another end of the linking member is pivotally attached to the rear leg frame and the above fixed member is mounted on the rear leg frame.

2. The collapsible reclining chair according to claim 1, wherein the positioning cover has a controlling portion for providing adjustment to users.

3. The collapsible reclining chair according to claim 1, wherein the housing body further includes a connecting portion used to connect the front leg frame.

4. The collapsible reclining chair according to claim 1, wherein the fixed member further includes a sliding slot and a fixed plate formed on the rear leg frame at a relative position to the sliding slot.

5. The collapsible reclining chair according to claim 1, wherein the dwelling portion of the coupling member having male thread, and the interior of the fixed member further having female thread in accordance to the male thread of the dwelling portion.

* * * * *